US005079904A

United States Patent [19]

Berube

[11] Patent Number: 5,079,904

[45] Date of Patent: Jan. 14, 1992

[54] BRIDLE

[76] Inventor: Dennis J. Berube, 6306 W. Vinyard, LaVeen, Ariz. 85339

[21] Appl. No.: 515,220

[22] Filed: Apr. 27, 1990

[51] Int. Cl.[5] ..... B68B 1/04

[52] U.S. Cl. ..... 54/6 R; 54/24

[58] Field of Search ..... 54/6 R, 6 A, 24

[56] References Cited

U.S. PATENT DOCUMENTS

| | | | |
|---|---|---|---|
| 291,596 | 1/1884 | Hitt | 54/6 R |
| 1,325,061 | 12/1919 | Veal | 54/24 |
| 2,415,903 | 2/1947 | Norris | 54/6 R |
| 2,426,427 | 8/1947 | Bass | 54/6 R X |
| 3,263,399 | 8/1966 | Faragher | 54/6 R |

*Primary Examiner*—Robert P. Swiatek

*Attorney, Agent, or Firm*—Don J. Flickinger; Jordan M. Meschkow

[57] ABSTRACT

A horse restraining apparatus includes a headstall having a pair of cheek pieces which fit on opposite sides of a horse's muzzle. The cheek pieces are attached to a nose band which encircles the horse's muzzle. Bit attachment elements are provided at the end of each cheek piece for removably coupling a bit to the headstall. When the bit is attached to the headstall, the apparatus functions as a bridle. When the bit is removed, the apparatus functions as a harness.

6 Claims, 1 Drawing Sheet

BRIDLE

BACKGROUND OF THE INVENTION

1. Field of the Invention

This invention relates to equipment used with riding animals.

More particularly this invention relates to a bridle which may be used as a halter.

2. Prior Art

Halters and bridles are well known, and have been in use for many years serving distinct and useful functions. Halters are fitted onto an animal, such as a horse or mule, and used for a variety of purposes. When a lead shank is attached, the halter may be used for leading or tethering the animal. A halter is used to obtain a measure of control over the animal. The halter fits securely over the head and is usually formed from strong material that resists breaking.

A bridle also fits over a horse's head in a manner similar to a halter. However, it includes a bit which fits into a horse's mouth. The bridle allows a much subtler control of the horse and is used when the horse is ridden.

The halter and bridle have been used for many years and work very well for their intended functions. However, problems often develop when changing from halter to bridle. The halter is used to secure a horse when saddling, but must be removed to allow the bridle to be put on the horse. This is when problems can occur. When the halter is removed, control over the horse may be lost. This may be due to the nature of the horse or some external factor causing the horse to take fright. If this happens when the halter has been removed the horse is free to bolt. Many times a halter will be removed from the head and refastened around the horse's neck to retain some control. The bridle may then be fastened onto the horse's head. However, this was not the way the halter was designed to be used and may be awkward.

Also, when the halter is off or fastened around the horse's neck there is very little or no control of a horse's head. The horse may then throw its head, hindering attempts to put on the bridle. Some horses may even attempt to bite. Without some means of restraint, this could be a painful problem.

Another problem arises when a bridle is in place. Many times a rider would like to tether the horse for a short time. A horse tethered with a bridle and having a bit in its mouth is in danger of being injured. The solution is to exchange the halter for the bridle, which causes the problems mentioned before to arise.

It would be highly advantageous, therefore, to remedy the foregoing and other deficiencies inherent in the prior art.

Accordingly, it is an object of the present invention to provide a new and improved bridle.

Another object of the invention is to provide a bridle which may be safely used as a halter.

And another object of the present invention is to provide a bridle with a bit that can be easily attached and removed.

Still another object of the invention is to provide a bridle which may be easily transformed into a halter.

SUMMARY OF THE INVENTION

Briefly, to achieve the desired objects of the instant invention in accordance with a preferred embodiment thereof, provided is a headstall having a pair of cheek pieces which fit one to either side of a horse's muzzle. The cheek pieces are attached to a noseband which encircles the horse's muzzle. When a bridle is required, a bit is attached adjacent to the nose band by attachment means located at the end of each cheek piece. The present invention is thus a bridle which can be used as a halter when the bit is removed.

BRIEF DESCRIPTION OF THE DRAWINGS

The foregoing and further and more specific objects and advantages of the instant invention will become readily apparent to those skilled in the art from the following detailed description of a preferred thereof taken in conjunction with the drawings, in which.

PREFERRED EMBODIMENT OF THE PRESENT INVENTION

Figure 1:
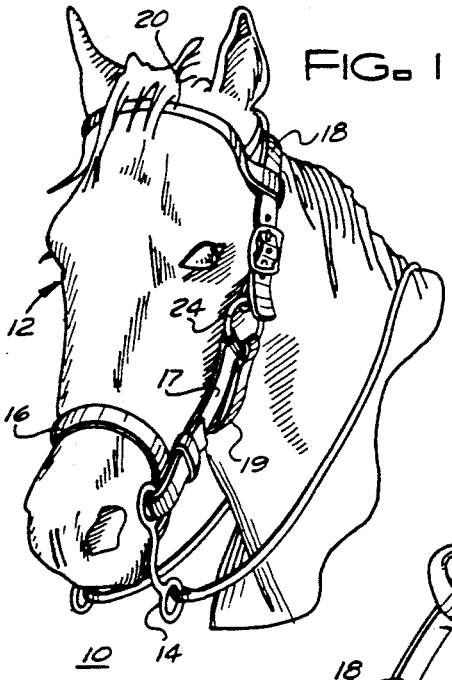
FIG. 1 is a perspective view of a bridle, constructed in accordance with the teachings of the present invention as it would appear fastened to the head of a horse.

Turning now to the drawings in which like reference characters indicate corresponding elements throughout the several views, attention is first directed to FIG. 1 which illustrates the present invention, a bridle generally designated 10, fastened to a horse's head 12. Bridle 10 has a headstall 13 shown in FIGS. 2 and 3 and a bit 14 attached to headstall 13 by bit attachment means 15.

Figure 2:
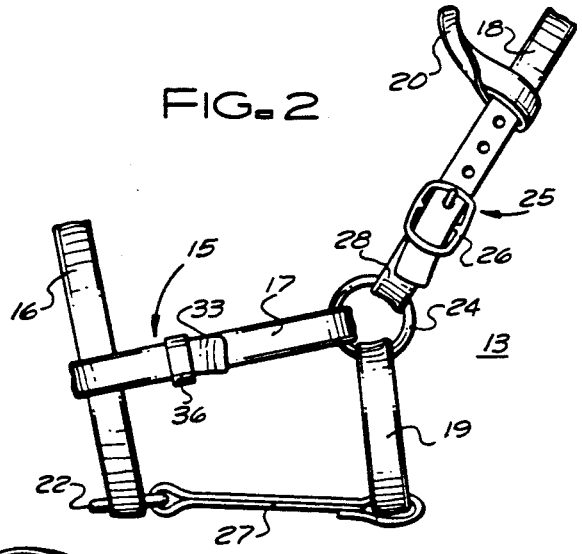
FIG. 2 is a side view of the headstall of the present invention.
Figure 3:
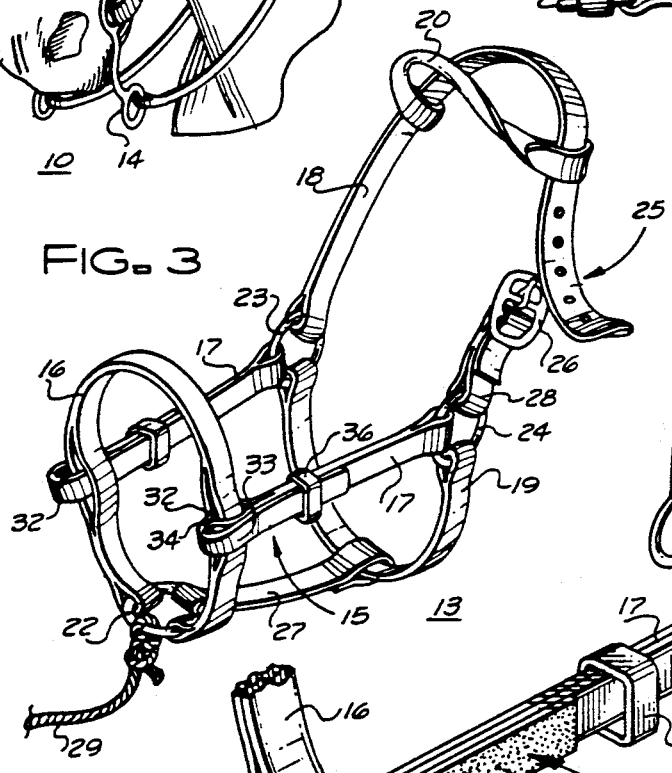
FIG. 3 is a perspective view of the headstall of the present invention with a lead shank attached, for use as a halter.
Figure 5:
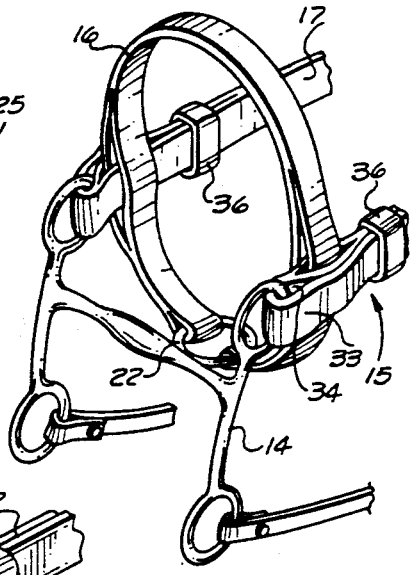
FIG. 5 is a partial view of the present invention showing bit and bit attachment means.

FIGS. 2 and 3 illustrate headstall 13, which has a nose band 16, cheek pieces 17, crown piece 18, throat latch 19 and brow band 20. Nose band 16 is a strip of material bent into a loop with both ends attached to an O-ring 22. Cheek pieces 17*a* and 17*b* are strips of material each with an end attached to opposite sides of nose band 16 and the other ends attached to O-rings 23 and 24 respectively. Throat latch 19 is a strip of material with one end coupled to the bottom of O-ring 23 and the other to the bottom of O-ring 24. Crown piece 18 is a strip of material with one end fastened to the top of O-ring 23 and the other end to the top of O-ring 24. Brow band 20 is a strip of material with each end coupled to crown piece 18.

Crown piece 18 is fastened to O-ring 24 by adjustable coupling means 25. In this preferred embodiment adjustable coupling means 25 consists of a buckle 26 attached to O-ring 24 by a short strip of material 27. The end of crown piece 18 which is to be attached to O-ring 24 has a number of holes 28 which allow it to be adjustably attached to buckle 26.

Referring back to FIG. 1, it can be seen that nose band 16 encircles the horse's muzzle with cheek pieces 17 extending along either jaw line. Crown piece 18 loops over the crown of head 12 behind the ears, with brow band 20 extending across the brow of head 12 to prevent crown piece 18 from slipping down. Throat latch 19 loops under head 12 at the junction of the throat and head 12. A short strip of material 28 is coupled to O-ring 22 and the middle portion of throat latch 19 to help headstall 13 retain its shape. When used as a halter, a lead shank 29 may be attached to O-ring 22 as illustrated in FIG. 3. Also O-rings 23 and 24 may be used when cross tying, as with a standard halter.

Figure 4:
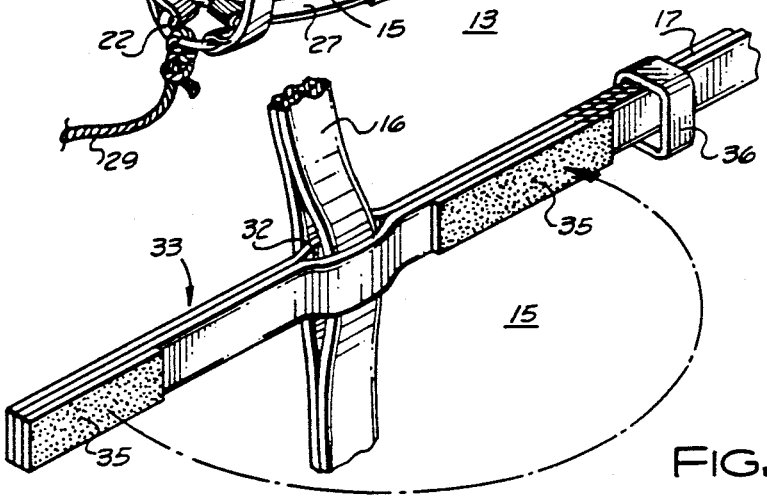
FIG. 4 is a partial view of the present invention showing bit attachment means.

FIG. 4 illustrates bit attachment means 30 which attaches bit 14 to headstall 13. Cheek pieces 17 are two layered. A small separation 32*a* and 32*b* is formed between the layers of each cheek piece 17*a* and 17*b* respectively where they attach to nose piece 16. Nose piece 16 is also formed from two layers, one of which goes through separations 32*a* and 32*b*. The material of nose band 16 and cheek pieces 17*a* and 17*b* may then be joined by stitching or any other means known to those skilled in the art. It will also be understood by those skilled in the art that two layered cheek pieces need not be used to join cheek piece 17 to nose band 16. An alternative may be stitching cheek piece 17 to nose band 16. In this embodiment bit attachment means 30 consists of portions 33*a* and 33*b* extending from cheek pieces 17*a* and 17*b* respectively, past nose band 16. Each portion 33*a* and 33*b* is doubled outwardly back upon cheek piece 17*a* and 17*b*. Portions 33*a* and 33*b* are attached to cheek pieces 17*a* and 17*b* by fastening means forming loops 34. In this embodiment portions 33*a* and 33*b* are coupled to cheek pieces 17*a* and 17*b* respectively by pressure-sensitive, resilient hook and loop fasteners such as the type marketed under the name Velcro ® on the outside of portions 33*a* and 33*b* and cheek pieces 17*a* and 17*b*. A ring 36 may be used to slide down over the junction of portion 33*a* and 33*b* and cheek pieces 17*a* and 17*b* to prevent accidental separation. A bit 14 is attached by passing portions 33*a* and 33*b* through rings 37 of bit 14 then doubling portions 33 back and attaching them to cheek pieces 17.

Thus, bridle 10 may be used without bit 14, as a halter to tether a horse, then bit 14 can be added for riding purposes. Bit 14 may be removed at any time to prevent damage to the horse's mouth, and control over the horse's head is never relinquished.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A restraining apparatus for a horse, comprising:
a) a headstall including
i) a nose band for encircling the horse's muzzle,
ii) a crown piece for extending over the horse's head behind the ears,
iii) at least two cheek pieces attaching said nose band to said crown piece, each of said cheek pieces including a first end proximate said nose band and a second end proximate said crown piece,
iv) a throat latch with ends attached to the second end of each of said cheek pieces,
v) receiving means coupled to said nose band for residing under the horse's muzzle and removably receiving a tether, and
vi) a connector strap having a first end attached to said receiving means and a second end attached to said throat latch for extending lengthwise along the underside of the horse's muzzle to retain the shape of said headstall;
b) a bit; and
c) bit attachment means for removably attaching said bit to said cheek pieces, said bit attachment means including
i) a connector ring provided at each end of said bit,
ii) an extension portion at said first end of each of said cheek pieces extending beyond said nose band, and
iii) pressure-sensitive fastening means for releasably joining each of said extension portions to an intermediate portion of its corresponding cheek piece after each of said extension portions is passed through a corresponding one of said connector rings and doubled back to form a loop for retaining said ring, said pressure-sensitive fastening means including
a first element provided on said extension portion of each of said cheek pieces, and
a second element provided on each of said cheek pieces at a location intermediate said first and second ends for engaging the corresponding first element in response to a pressure force of predetermined magnitude being exerted on said second element in a direction toward said first element and for disengaging said first element in response to a pulling force of predetermined magnitude being exerted on said second element away from said first element;

wherein said apparatus functions as a bridle when said bit is attached to said cheek pieces, and as a harness when said bit is removed from said cheek pieces.

2. An apparatus as claimed in claim 1, wherein:
a) one of said first element and said second element comprises at least one loop; and
b) the other of said first element and said second element comprises at least one resilient hook for releasably engaging said at least one loop.

3. An apparatus as claimed in claim 2, wherein:
a) said at least one loop comprises a plurality of loops; and
b) said at least one resilient hook comprises a plurality of resilient hooks.

4. An apparatus as claimed in claim 1, further comprising a ring slideably mounted on each of said cheek pieces for encircling said cheek piece and the corresponding doubled over extension portion to prevent accidental separation of said extension portion from said cheek piece.

5. A restraining apparatus for a horse, comprising:
a) a headstall including
i) a nose band for encircling the horse's muzzle,
ii) a crown piece for extending over the horse's head behind the ears,
iii) at least two cheek pieces attaching said nose band to said crown piece, each of said cheek pieces including a first end proximate said nose band and a second end proximate said crown piece,
iv) a throat latch with ends attached to the second end of each of said cheek pieces,
v) receiving means coupled to said nose band for residing under the horse's muzzle and removably receiving a tether, and
vi) a connector strap having a first end attached to said receiving means and a second end attached to said throat latch for extending lengthwise along the underside of the horse's muzzle to retain the shape of said headstall;

b) a bit;

c) bit attachment means for removably attaching said bit to said cheek pieces; and d) adjustable coupling means for adjustably coupling one end of said crown piece to the second end of one of said cheek pieces, said adjustable coupling means including i) a connector ring carried at said second end of said one cheek piece, ii) a strap having a first end and a second end, said first end being mounted for movement along the circumference of said connector ring to allow variation of the angular orientation of said strap relative to said cheek piece and iii) connector means for detachably coupling said strap to said crown piece at a selected one of a plurality of attachment sites, whereby said apparatus functions as a bridle when said bit is attached to said cheek pieces, and as a harness when said bit is removed from said cheek pieces.

6. An apparatus according to claim 5, wherein said connector means comprises:

a) a first element of an engagement pair carried at said second end of said strap; and b) a second element of said engagement pair carried by said crown piece for releasably engaging said first element.

* * * * *

UNITED STATES PATENT AND TRADEMARK OFFICE

CERTIFICATE OF CORRECTION

PATENT NO. : 5,079,904

DATED : 14 January 1992

INVENTOR(S) : Dennis J. Berube

It is certified that error appears in the above-identified patent and that said Letters Patent is hereby corrected as shown below:

Column 4:

In Claim 1, line 24, change "pressure" to --pressing--, and in Claim 1, line 31, change "wherein" to --whereby--.

Signed and Sealed this

Twenty-third Day of March, 1993

*Attest:*

STEPHEN G. KUNIN

*Attesting Officer*

*Acting Commissioner of Patents and Trademarks*